United States Patent [19]

Price et al.

[11] Patent Number: 4,466,367

[45] Date of Patent: Aug. 21, 1984

[54] INTERMITTENT TOP SHIRRING ATTACHMENT FOR SEWING MACHINE

[75] Inventors: Elvin C. Price, Lawrenceville; James R. Young, Buford; Joseph A. Bottoms, Lawrenceville, all of Ga.

[73] Assignee: Atlanta Attachment Company, Lawrenceville, Ga.

[21] Appl. No.: 433,557

[22] Filed: Oct. 8, 1982

[51] Int. Cl.[3] ..... D05B 27/12; D05B 35/08

[52] U.S. Cl. ..... 112/134; 112/262.1; 112/322

[58] Field of Search ..... 112/134, 322, 132, 133, 112/135, 320, 262.1

[56] References Cited

U.S. PATENT DOCUMENTS

| | | | |
|---|---|---|---|
| 1,990,616 | 2/1935 | Rubel | 112/322 |
| 2,128,353 | 8/1938 | Dowd | 112/322 |
| 2,170,948 | 8/1939 | Meyer | 112/322 |

OTHER PUBLICATIONS

Instructions Handbook, Rimoldi 527,529, cover, pp. 58, 59, 60 & 61, and back cover.

*Primary Examiner*—Werner H. Schroeder
*Assistant Examiner*—Andrew M. Falik
*Attorney, Agent, or Firm*—Thomas & Kennedy

[57] ABSTRACT

A shirring attachment includes a rotatable feed wheel 51 positioned over a stripper blade 60 and normally positioned in spaced relationship above the work surface of and in front of the sewing needle 45 of a sewing machine. A first ply of material 78 is extended over the work surface and beneath the stripper blade to the feed dogs 68 of the sewing machine, and a second ply of material 80 is extended over the stripper blade to the sewing needle. The rotatable feed wheel is driven with a peripheral velocity that corresponds to the speed of the sewing machine motor, usually at a higher velocity that the feed dogs, and the feed wheel is moved by an air-actuated cylinder 54 at the command of the machine operator down toward the stripper blade into engagement with the upper ply of material so as to feed the upper ply of material to the sewing needle at a faster rate than the movement of the lower ply of material. The upper ply of material is gathered at the needle of the sewing machine and sewn in its gathered condition to the lower ply of material.

10 Claims, 7 Drawing Figures

INTERMITTENT TOP SHIRRING ATTACHMENT FOR SEWING MACHINE

TECHNICAL FIELD

This invention relates to sewing methods and apparatus, and particularly to a method and apparatus for shirring layers of material, whereby the top ply of two plies of material fed to a sewing needle is progressively gathered at the sewing needle and sewn to the lower ply of material to form a series of close, parallel gathers in the upper ply of material stitched to the flat lower ply of material.

BACKGROUND ART

Various attachments have been utilized in the past for automatically forming pleats, ruffles and shirrs in garments and other sewn materials. For example, prior art shirring equipment utilizes separately operated feed dogs at the sewing needle of the sewing machine, whereby feed dogs beneath the presser foot pull the bottom ply of material at a predetermined rate to the sewing needle, and another feed dog ahead of the presser foot pulls the bottom ply of material at a faster rate toward the sewing needle, whereby the bottom ply of material is gathered by the first feed dogs and then both the bottom and top plies of material which are pressed toward the second set of feed dogs by the presser foot are moved at a slower rate to the sewing needle. This results in progressive gathering of the bottom ply of material and attaching the bottom ply in its gathered condition to the relatively flat top ply of material. While this procedure has been successful in forming shirred structures, the operator of such equipment is somewhat handicapped during the operation of the sewing equipment in that the lower ply of material that is being gathered at the sewing needle is hidden by the upper ply of material, and the operator must stop the process from time to time in order to assure that the work product is being properly formed.

Other equipment has been utilized to form pleats and ruffles in the top ply of material fed to sewing machines. These prior art devices include a reciprocatable feed blade that works against a stripper blade in front of the sewing needle, with the upper ply of material extending over the stipper blade. The feed blade engages the upper ply of material and pushes it at a faster rate across the stripper blade toward the sewing needle, while the conventional feed dogs move the lower ply of material at a slower rate to the sewing machine. When this procedure is performed for each stitch of the sewing machine, it is considered as a "ruffling" process, and when this procedure is performed for every third or more stitches of the sewing machine it is considered to be a "pleating" process. Both ruffling and pleating substantially reduce the speed of operation of the sewing machine, for example from about 7000 r.p.m. to about 4000 r.p.m. for ruffling, and from about 7000 r.p.m. to about 3000 r.p.m. for pleating. Moreover, it is difficult to stop and start the ruffling and pleating functions in the middle of a sewing run with the prior art attachments, so that the operator cannot maintain high production of the work product when the ruffling or pleating procedures must be initiated or terminated during the sewing run on the work product.

Another example of prior art is the use of a rotatable feed wheel positioned in front of the sewing needle of a sewing machine with the feed wheel working against a stipper plate. The feed wheel runs substantially at the same effective speed as the feed dogs of the sewing machine for the purpose of feeding the upper ply of material positively to the sewing needle at the same rate of feed as the lower ply of material is fed by the feed dogs, so that no relative stretching or bunching of the two plies of material is experienced in the work product. The feed wheel is operated by the sewing machine motor at a speed which directly corresponds to the speed of operation of the feed dogs and the feed wheel constantly engages the upper ply of material.

SUMMARY OF THE INVENTION

Briefly described, the present invention comprises a shirring attachment for a sewing machine which utilizes a feed wheel or roller driven by the sewing machine motor and mounted in front of the sewing needle of the sewing machine and which, at the selection of the machine operator, engages the top ply of material and moves the top ply of material toward the sewing needle at a faster rate than the lower ply of material is moved by the conventional feed dogs of the sewing machine. This results in the top ply of material being gathered at the needle of the sewing machine and the two plies of material are sewn together in this configuration.

The feed roller works against a stripper blade that is spaced upwardly from the work surface of the sewing machine, and the upper ply of material passes over the stipper blade so that the upper ply of material is slightly separated from the lower ply of material as the upper ply of material is fed across the stripper blade to the sewing needle. The feed roller is movable toward and away from the stripper blade by an air cylinder that is actuated by the manipulation of a foot pedal by the machine operator, so that the feed roller selectively engages and disengages the upper ply of material during the sewing function. This results in the upper ply of material being gathered at the sewing needle or, alternatively, results in the upper ply of material beng pulled in a flat configuration by the lower ply of material toward the sewing needle.

The selective engagement of the feed roller with the upper ply of material enables the operator to initiate and to terminate the shirring function in the middle of a sewing run without interrupting the high-speed operation of the sewing machine. Also, the upper ply of material remains visible during the entire shirring operation, so that the sewing machine operator is able to determine the exact instants during the sewing operation when the shirring function should be initiated and terminated.

Thus, it is an object of this invention to provide a shirring attachment for a sewing machine whereby the top layer of two layers of material can be moved at a faster rate than the bottom layer to the sewing needle in order to form gathers in the top layer of the work product, and to provide a control system whereby the fast-feed operation of the top layer of material can be activated by the sewing machine operator at any time during a high-speed sewing run.

Another object of this invention is to provide a shirring attachment for a high-speed sewing machine which can be operated intermittantly at the selection of the machine operator, which functions to gather the top ply of a multiple-ply work product, and which is mechanically connected to the sewing machine motor so as to operate in response to the operation of the sewing machine.

Another object of this invention is to provide an intermittent feed shirring attachment for a sewing machine which can be operated accurately and at high operational speeds by a sewing machine operator to form a work product that has a top ply of material gathered at the stitching of the work product.

Another object of the invention is to provide an inexpensive shirring attachment for mounting to a conventional sewing machine, which is driven by the sewing machine, which is durable and versatile, and which is easy to control by the sewing machine operator.

Other objects, features and advantages of the present invention will become apparent upon reading the following specification, when taken in conjunction with the accompanying drawings.

DETAILED DESCRIPTION

Figure 1:
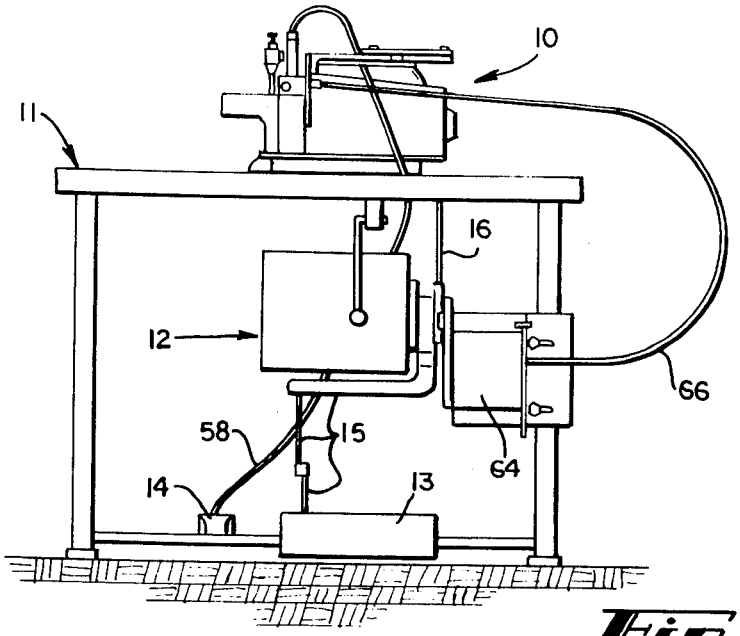
FIG. 1 is a side elevational view of a sewing machine, its work table, motor with clutch-brake, pedal controls, the shirring attachment, and the variable speed transmission interconnected between the motor and the shirring attachment.

Referring now in more detail to the drawings, in which like numerals indicate like parts throughout the several view, FIG. 1 illustrates a conventional sewing machine 10 mounted to a work table 11, with clutch-brake motor 12 positioned beneath the surface of the work table, and with foot pedals 13 and 14 positioned adjacent the floor surface. Foot pedal 13 is connected by a linkage 15 to the clutch-brake motor 12, while foot pedal 14 controls the operation of the shirring attachment, as explained more fully hereinafter. V-belt 16 extends from the driving sheave of the motor 12 up through the work surface of the work table and drives the sewing machine 10 in the conventional manner.

Figure 2:
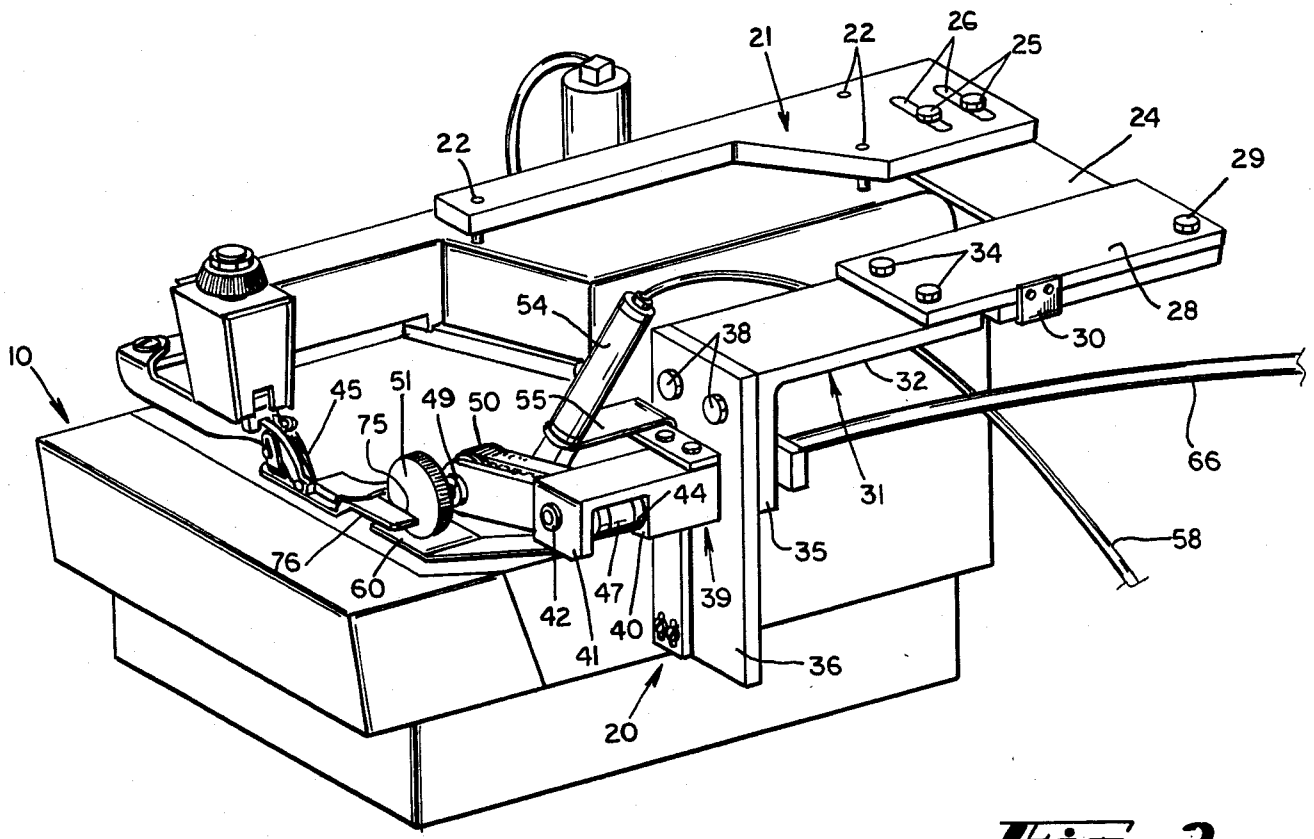
FIG. 2 is a perspective illustration of the sewing machine with the shirring attachment mounted thereon.
Figure 4:
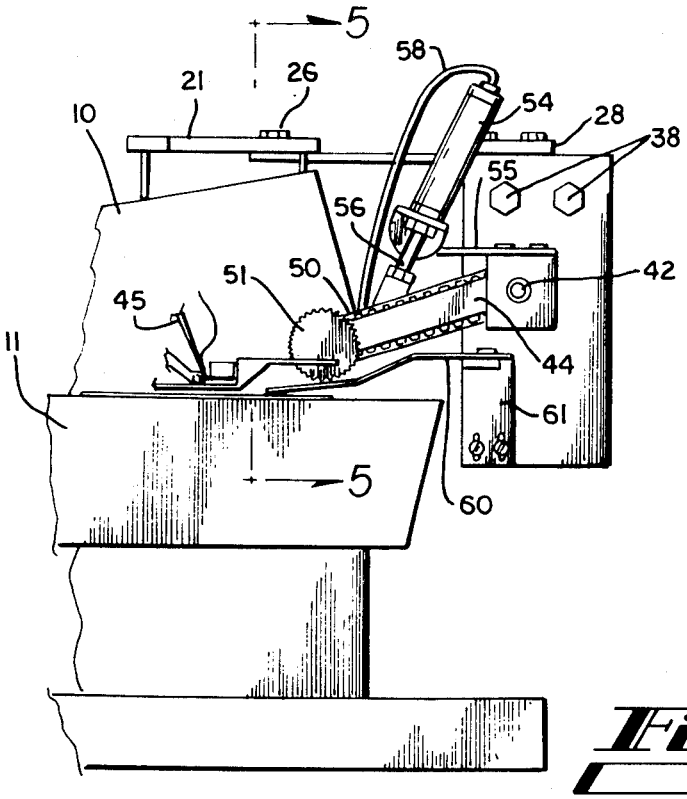
FIG. 4 is a side elevational view of the shirring attachment.
Figure 5:
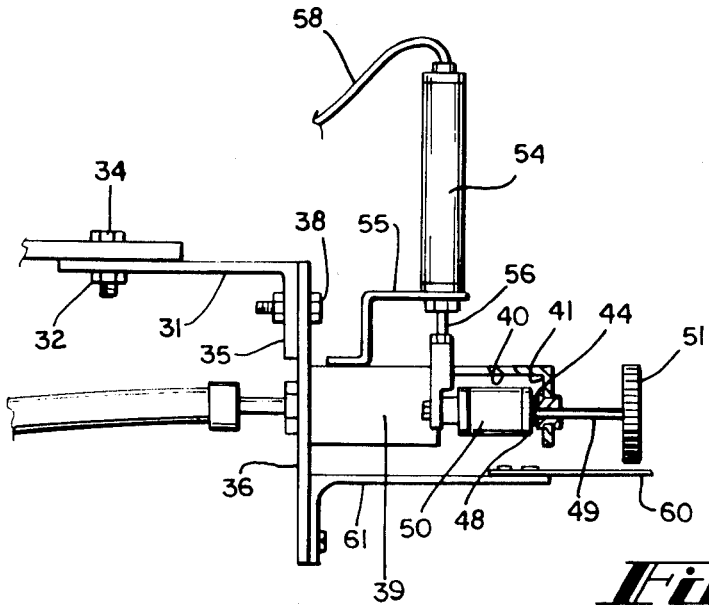
FIG. 5 is an end view of the shirring attachment, taken along lines 5—5 of FIG. 4.

As illustrate in FIG. 2, shirring attachment 20 is mounted to sewing machine 10 and includes stationary mounting plate 21 which is fastened to the top of the sewing machine by screws 22, adjustable mounting plate 24 which is movably connected to the stationary mounting plate 21 by means of bolts 25 extending through elongated slots 26 of the mounting plate 21 and through openings (not shown) of the adjustable mounting plate 24.

Movable support plate 28 is pivotably connected to adjustable mounting plate 24 by means of pivot bolt 29 extending through aligned openings in the plates 24 and 28. Movable support plate can be pivoted in a horizontal plane about pivot bolt 29 away from the front of the sewing machine, or back into the position as illustrated. Tab 30 is mounted to one edge of movable support plate 28 so as to limit the movement of the support plate toward the front on the sewing machine. L-shaped support bracket 31 includes a horizontal leg 32 bolted to movable support plate 28 by means of bolts 34, and a vertical leg 35 extending downwardly from horizontal leg 32. Vertical mounting plate 36 is bolted to vertical leg 35 by means of bolts 38.

Figure 3:
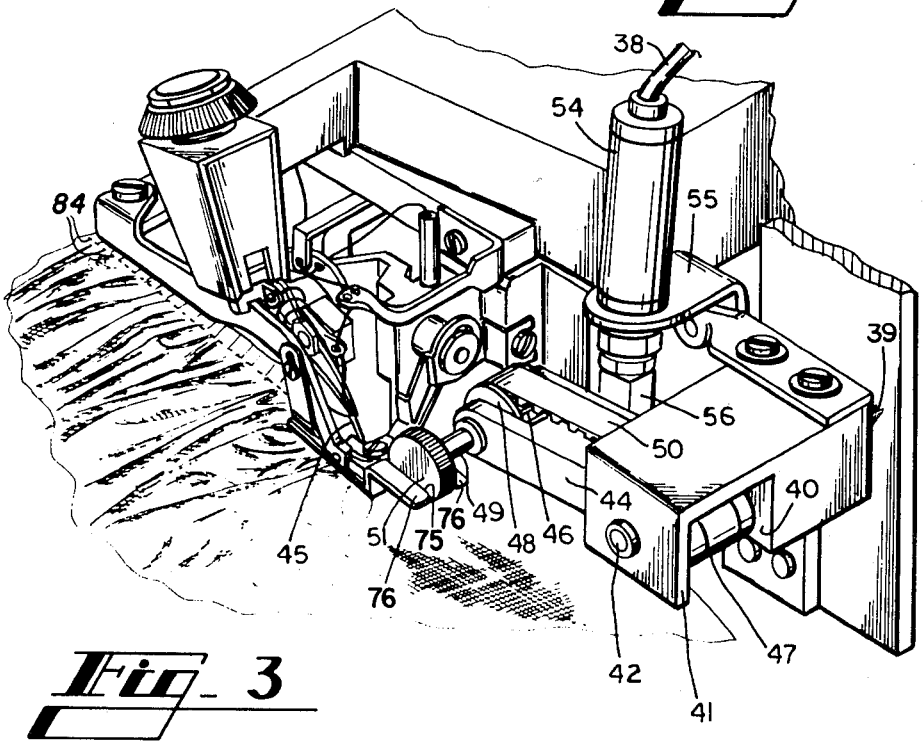
FIG. 3 is a closer perspective illustration of a portion of the sewing machine and of the shirring attachment attached thereto.

As illustrated in FIGS. 2 and 3, drive support block 39 of shirring attachment 20 is approximately rectangular with one end portion butted against vertical mounting plate 36, with attachment screws (not shown) extending through mounting plate 36 and into the end portion of the drive support block 39 to hold the drive support block in place against the mounting plate. Drive support block 39 further includes a downwardly facing slot 40 which extends through both the front and rear surfaces of the block, leaving a downwardly protruding wall 41 at the end of the support block remote from mounting plate 36. Drive support lever arm is pivotably mounted on axle 42 and extends from the slot 40 of the drive support block 39 toward the sewing needle 45. The drive support lever arm 44 is slotted at both of its ends as illustrated at 46, and pulleys 47 and 48 are mounted in the slots 46 of the lever arm 44. The pulley 47 is mounted to driven axle 42, while the pulley 48 at the opposite end of the lever arm 44 is mounted to axle 49. Timing belt 50 extends about pulleys 47 and 48, so that pulley 48 is driven by pulley 47. Driven axle 49 extends laterally from the end portion of lever arm 44, and drive roller 51 is mounted on the protruding end portion of driven axle 49.

Fluid-actuated cylinder 54 is supported on drive support block 39 by means of bracket 55, and the piston rod 56 of cylinder 54 is pivotably connected to drive support lever arm 44. A coil compression spring (not shown) is located within fluid-actuated cylinder 54 so that the piston rod 56 is always spring-biased in an upward or retracted direction. Fluid pressure line 58 communicates with the upper end portion of cylinder 54 so as to pressurize the upper end portion of the cylinder and to move the piston rod 56 downwardly. This tends to pivot the drive support lever arm 44 and drive roller 51 in a downward direction. The fluid pressure communicated through fluid pressure line 58 is controlled by a valve (not shown) at the foot pedal 14 adjacent the floor under the work table.

Stripper blade or plate 60 is mounted to vertical mounting plate 36 by means of bracket 61. Stripper blade 60 extends beneath drive roller 51 and is maintained in closely spaced relationship with respect to the working surface of work table 11 in front of the sewing needle 45. Thus, stripper blade 60 functions as a platform extending between the working surface of the sewing machine and the drive roller 51.

As illustrated in FIG. 1, variable speed transmission 64 is supported beneath the work table and is driven by V-belt 16 from clutch-brake motor 12. A shrouded cable 66 extends from variable speed transmission 64 up to shirring attachment 20. The driven cable (not shown) of the shrouded cable 66 extends through vertical mounting plate 36 and through drive support block 39 and is connected at its end to driven axle 42. With this arrangement, the shrouded cable 66 is rotated in direct response to the operation of motor 12, at a speed directly proportional to the speed of operation of the motor, so that drive roller 51 of shirring attachment 20 is also rotated with a peripheral velocity proportional to the speed of operation of the feed dogs and sewing needle of the sewing machine. The variable speed transmisssion 64 is a conventional Zero-Max transmission, and the output to the shrouded cable 66 is variable by adjusting a lever on the transmission. Therefore, since the shrouded cable is rotated at a speed of rotation directly proportional to the speed of operation of motor 12, the speed ratio of the drive roller 51 and the feed dogs remains constant at slow or fast speeds of sewing machine operation.

Figure 6:
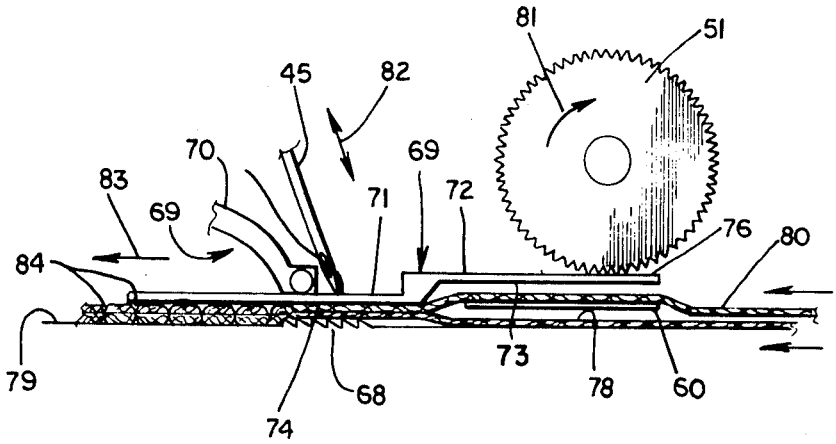
FIGS. 6 and 7 are schematic side elevational views of the feed roller and stripper blade placed in front of the sewing needle of a sewing machine, showing the feed roller raised in FIG. 6 and showing the feed roller lowered in FIG. 7.

As illustrated in FIG. 6, the sewing machine includes needle 45, feed dogs 68 and presser foot 69. While feed dogs 68 and needle 45 are of conventional construction, presser foot 69 is of unique construction in that it includes a conventional support stem 70, lower foot section 71 and upper foot section 72. The bottom surface 74 of lower foot section 71 is positioned directly over the feed dogs 68 and is movable vertically toward and away from the feed dogs under the control of the machine operator. The upper foot section 72 extends forwardly of the feed dogs and sewing needle 45 and is stepped up and its bottom surface 73 extends over stripper blade 60. Therefore, the bottom surfaces of the presser foot 69 are stepped upwardly from the feed dogs 68. The upper foot section 72 of the presser foot 69 is bifurcated, and a slot 75 (FIGS. 2 and 3) is formed between the tines 76 for receiving drive roller 51. Therefore, drive roller 51 is movable from its up position as illustrated in FIG. 6 to a down position as illustrated in FIG. 7 by protruding through the slot formed between the tines of the upper section of the presser foot, so that the drive roller works against the upper surface of stripper blade 60 and the ply of material extending across the stripper blade.

As illustrated in FIG. 6, the operator of the sewing machine extends a lower ply of material 78 across the work surface 79 to the feed dogs 68, and then extends a second, upper ply of material 80 beneath drive roller 51 and over stripper blade 60, and then down onto the lower ply of material 78 to the feed dogs 68. The presser foot 69 is then lowered and the sewing operation commences.

When the sewing operation is initiated, the drive roller 51 rotates in the direction indicated by arrow 81, the sewing needle reciprocates as indicated by double-headed arrow 82, and the feed dogs 68 operate to move the plies of material across the work surface in the direction indicated by arrow 83. The sewing machine functions to form a conventional work product, with both plies of material in flat overlying relationships and with stitching 84 formed through the plies of material, thus holding the plies of material together. In the meantime, drive roller 51 rotates as indicated by arrow 81, but since the drive roller is maintained in its up position, the peripheral surface of the drive roller does not contact the upper ply of material 80, and the upper ply of material is not gathered as the sewing function continues.

Figure 7:
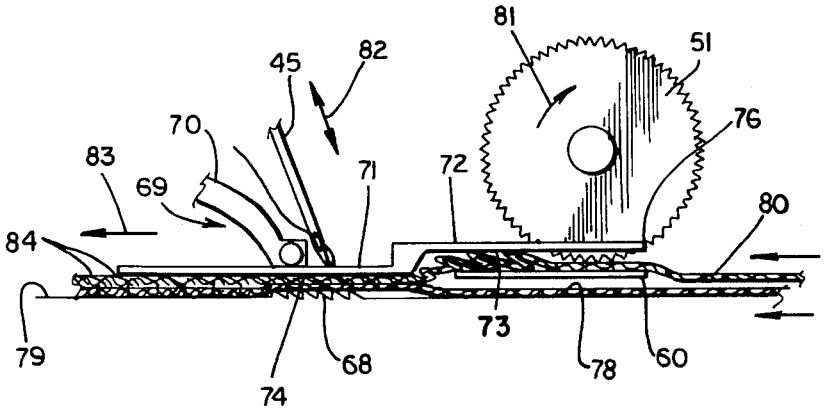

When the operator presses foot pedal 14, a supply of air under pressure is communicated through conduit 58 to the upper end portion of fluid-actuated cylinder 54, thereby causing the piston rod 56 to project downwardly and pivot drive support lever arm 44 about driven axle 42, thereby causing drive roller 51 to move downwardly into driving engagement with the upper ply of material 80 (FIG. 7). The stripper blade 60 functions as a platform so that the upper ply of material 80 is held in frictional contact against the peripheral edge of drive roller 51.

If the variable speed transmission 64 has been adjusted so that the peripheral velocity of drive roller 51 is higher than the movement of the lower ply of material 68 through the sewing machine, the upper ply of material will be moved at faster speed to the sewing needle than the lower ply of material. The upper ply of material tends to become gathered beneath the presser foot 69 (FIG. 7), and when the upper ply of material moves off the stripper blade 60, it is carried by the movement of the lower ply of material on beneath the lower foot section 71 of presser foot 69 over feed dogs 68 and beneath sewing needle 45. Therefore, the upper ply of material is presented to the needle in a gathered condition, and the stitching 84 formed through the plies of material holds the gathered upper ply in this configuration against the relatively flat lower ply of material. The stepped bottom surface of the presser foot permits the portion of the presser foot extending over the stripper blade 60 to receive the upper ply of material in its bunched or gathered configuration and then to guide the gathered material downwardly to the moving upper surface of the lower ply of material and then on to the needle.

The control system for the shirring attachment enables the operator to initiate the gathering of the upper ply of material or to terminate the gathering of the upper ply of material without interupting the normal sewing function of the sewing machine, even during the middle of high-speed runs. Moreover, since the upper ply of material that is to be gathered is completely visible to the sewing machine operator, the sewing machine operator can watch for notches or other indications on the upper ply of material to determine when the gathering process should be initiated or terminated, and this initiating or terminating of the gathering step is performed by simply depressing or releasing foot pedal 14.

In the event that the operator wishes to remove the shirring attachment from the vicinity of the sewing machine, the operator can pull the shirring attachment away from the front of the sewing machine and the shirring attachment will pivot about pivot bolt 29 completely out of the way. This can be done without having to disconnect shrouded cable 66, since the cable is somewhat flexible.

In the event that two stretchable plies of material are being sewn together and it is desirable to have then sewn together in flat configurations, the shirring attachment can be utilized so as to positively feed the upper ply of material to the sewing machine at a velocity equal to the feed of the lower ply of material by adjusting variable speed transmission 64. This tends to avoid the stretching or contortion of the upper ply of material due to the drag of the presser foot against the upper ply of material as the feed dogs move the lower ply of material through the sewing machine.

While this invention has been described in detail with particular reference to a preferred embodiment thereof, it will be understood that variations and modifications can be effected within the spririt and scope of the invention as described hereinbefore and as defined in the appended claims.

We claim:

1. A shirring attachment for a sewing machine of the type having a work surface, a drive motor, reciprocatable needle means driven by the drive motor, feed means at the needle means and driven by the drive motor for moving a work product across the work surface to the needle means, and a presser foot adjacent the needle means for urging the work product downwardly toward the feed means; said shirring attachment comprising:

a support for mounting to the sewing machine, a platform movably supported by said support for positioning in front of the needle means in spaced relationship with the work surface, drive roller means mounted over said platform, means for moving the peripheral portion of said drive roller means toward and away from engagement with said platform, and a variable drive transmission operably connected to said drive roller means for connection to the motor of the sewing machine for rotating said drive roller in response to the operation of the motor of the sewing machine with a peripheral velocity that corresponds to the speed of operation of the motor of the sewing machine, whereby the peripheral velocity of the drive roller means can be varied with respect to the speed of operation of the sewing machine motor, whereby one ply of material is extended beneath the platform for movement by the feed means of the sewing machine toward the needle means and another ply of material is extended over the platform for movement by the drive roller means toward the needle means.

2. The shirring attachment of claim 1 and wherein the presser foot of the sewing machine is bifurcated and defines a slot, and wherein said support movably holds said drive roller means in the slot of the presser foot.

3. The shirring attachment of claim 1 and wherein said means for moving the peripheral portion of said drive roller means toward and away from engagement with said platform comprises an air-operated cylinder means operatively connected to said drive roller means for raising and lowering said drive roller means, and valve means for selectively directing air under presure to said cylinder means.

4. A method of shirring plies of material with a sewing machine of the type including a sewing needle and material feed means comprising arranging two plies of material in overlying relationship at the sewing needle of a sewing machine, placing the lower ply of material beneath a platform positioned in front of the sewing needle and placing the upper ply of material over the platform, engaging and pulling the lower surface of the lower ply of material with the material feed means of the sewing machine to pull the lower ply toward the sewing needle, intermittently engaging the upper surface of the upper ply of material with the peripheral portion of a drive roller urged toward the platform and rotating the drive roller at a speed sufficient to pull the upper ply toward the sewing needle at a faster rate than the movement of the lower ply of material toward the sewing needle, whereby the upper ply of material is gathered at the sewing needle, and sewing through both the upper and lower plies of material with the sewing needle as the upper ply of material is gathered at the sewing needle.

5. A shirring attachment for a sewing machine of the type including a work surface, a sewing needle, feed means at said sewing needle for engaging the bottom surface of a work product and moving the work product toward the sewing needle, said shirring attachment comprising:

a bifurcated presser foot defining a slot therein positioned adjacent the sewing needle, a platform movably suported in front of the sewing needle in spaced relatinship with the work surface, said platform extending at least partially beneath the presser foot, drive roller means mounted over said platform in alignment with said needle means, means for intermittently moving the peripheral portion of said drive roller downwardly partially through the slot of said presser foot toward engagement with said platform and upwardly away from engagement with said platform, and means for rotating the drive roller, whereby a lower ply of material is extended beneath the platform and to the sewing needle of the sewing machine, an upper ply of material is extended over the platform and to the needle of the sewing machine, the feed means of the sewing machine engages and progressively moves the lower ply of material to the sewing needle and the drive roller means engages and progressively moves the upper ply of material to the sewing needle.

6. The shirring attachment of claim 5 and wherein said means for rotating the drive roller means comprises a driven pulley member mounted to said drive roller means, a drive pulley, belt means extending in driving relationship from said drive pulley about said driven pulley, and wherein said means for moving the peripheral portion of said drive roller toward and away from engagement with said platform comprises air-operated cylinder means operatively connected to said driven pulley and said drive roller means for reciprocating said driven pulley and said drive roller means toward and away from said platform.

7. The shirring attachment of claim 5 and wherein said means for rotating the drive roller means includes a variable speed transmission for operative connection to the motor of the sewing machine whereby the peripheral velocity of the drive roller means can be varied and is proportional to the speed of operation of the sewing machine motor.

8. A shirring attachment for a sewing machine of the type including a sewing needle and feed dogs for moving material to the sewing needle, said shirring attachment comprising a platform for positioning in front of the sewing needle, a drive roller positioned over said platform, means for moving said drive roller toward and away from said platform, means for rotating said drive roller, and a presser foot including a stepped bottom surface with a lower surface normally positioned below said platform and over the feed dogs and a higher surface normally extending over said platform, whereby a first ply of material is extended beneath the platfrom and beneath the lower surface of the presser foot and over the feed dogs, and a second ply of material is extended over the platform and beneath the higher surface of the presser foot and then over the first ply of material and beneath the lower surface of the presser foot, the feed dogs and sewing needle operated to sew together the plies of material, and the feed roller rotated at a peripheral velocity sufficient to move the upper ply of material to the sewing needle at a faster rate than the lower ply of material.

9. The shirring attachment of claim 8 and wherein the portion of said presser foot that extends over said platfrom is bifurcated with a slot formed therein, and wherein said drive roller is aligned with said slot and extends into said slot when moved toward said platform.

10. A shirring attachment for a sewing machine of the type having a work surface, a sewing needle that reciprocates from above and downwardly through the work surface, feed dogs at the sewing needle in the working surface for moving up from beneath the working surface to engage a work product and to move the work product to the sewing needle, the improvement comprising a platform positioned in front of the sewing needle and spaced over the work surface, a presser foot including a stepped bottom surface with a lower surface extending over the feed dogs and a higher surface extending over said platform and movable toward and away from the feed dogs and said platform, a drive roller above said platform and movable toward and away from engagement with said platform, and means for rotating said drive roller with peripheral velocity faster than the effective rate of movement of the feed dogs whereby a ply of material extending beneath the platform and over the feed dogs and beneath the lower surface of the presser foot is moved at a first rate toward the sewing needle, and another ply of material extending over the platform and beneath the drive roller and the higher surface of the presser foot and then over the first ply of material and beneath the lower surface of the presser foot is moved at a faster rate toward the sewing needle.

* * * * *